US006598260B1

(12) United States Patent
Sharpe

(10) Patent No.: US 6,598,260 B1
(45) Date of Patent: Jul. 29, 2003

(54) LIQUID BARRIER SYSTEM

(76) Inventor: Michael D. Sharpe, 2403 Park St., North, St. Petersburg, FL (US) 33710

( * ) Notice: Subject to any disclaimer, the term of this patent is extended or adjusted under 35 U.S.C. 154(b) by 353 days.

(21) Appl. No.: 09/627,473

(22) Filed: Jul. 28, 2000

(51) Int. Cl.[7] ..... B05C 21/00; A47L 25/00; A47L 13/52

(52) U.S. Cl. ..... 15/257.01; 15/1; 15/257.1; 210/924; 49/34

(58) Field of Search ..... 15/1, 257.01, 257.1; 52/102; 49/34; 482/82; 62/235; 405/115; 210/924; 134/201

(56) References Cited

U.S. PATENT DOCUMENTS 2,671,743 A 3/1954 Lindquist
4,178,717 A 12/1979 Sakauye
4,201,382 A * 5/1980 Wilson ..... 482/82
4,449,267 A 5/1984 Siemion
4,505,474 A * 3/1985 Mattox ..... 482/82
4,792,399 A * 12/1988 Haney et al. ..... 210/484
5,050,846 A * 9/1991 Goodman et al. ..... 256/1
5,173,346 A 12/1992 Middleton
5,345,731 A * 9/1994 Sykes ..... 52/102
D370,755 S 6/1996 Johnson, Sr.
5,830,281 A 11/1998 Kliewer et al.

* cited by examiner

*Primary Examiner*—Robert J. Warden, Sr.
*Assistant Examiner*—Laura C Cole

(57) ABSTRACT

A liquid barrier system for protecting selected areas of flooring from liquid flow. The liquid barrier system includes a pair of end assemblies adapted for abutting a surface of a floor, and an elongate barrier assembly having two ends, each one of the barrier assembly ends being coupled to an associated one of the end assemblies.

12 Claims, 2 Drawing Sheets

LIQUID BARRIER SYSTEM

BACKGROUND OF THE INVENTION

1. Field of the Invention

The present invention relates to protective barriers and more particularly pertains to a new liquid barrier system for protecting selected areas of flooring from liquid flow.

2. Description of the Prior Art The use of protective barriers is known in the prior art. More specifically, protective barriers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,830,281; 4,178,717; U.S. Pat. No. Des. 370,755; U.S. Pat. Nos. 2,671,743; 5,173,346; and 4,449,267.

While these devices fulfill their respective, particular objectives and requirements, the aforementioned patents do not disclose a new liquid barrier system. The inventive device includes a pair of end assemblies adapted for abutting a surface of a floor, and an elongate barrier assembly having two ends, each one of the barrier assembly ends being coupled to an associated one of the end assemblies.

In these respects, the liquid barrier system according to the present invention substantially departs from the conventional concepts and designs of the prior art, and in so doing provides an apparatus primarily developed for the purpose of protecting selected areas of flooring from liquid flow.

SUMMARY OF THE INVENTION

In view of the foregoing disadvantages inherent in the known types of protective barriers now present in the prior art, the present invention provides a new liquid barrier system construction wherein the same can be utilized for protecting selected areas of flooring from liquid flow.

The general purpose of the present invention, which will be described subsequently in greater detail, is to provide a new liquid barrier system apparatus and method which has many of the advantages of the protective barriers mentioned heretofore and many novel features that result in a new liquid barrier system which is not anticipated, rendered obvious, suggested, or even implied by any of the prior art protective barriers, either alone or in any combination thereof.

To attain this, the present invention generally comprises a pair of end assemblies adapted for abutting a surface of a floor, and an elongate barrier assembly having two ends, each one of the barrier assembly ends being coupled to an associated one of the end assemblies.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new liquid barrier system apparatus and method which has many of the advantages of the protective barriers mentioned heretofore and many novel features that result in a new liquid barrier system which is not anticipated, rendered obvious, suggested, or even implied by any of the prior art protective barriers, either alone or in any combination thereof.

It is another object of the present invention to provide a new liquid barrier system which may be easily and efficiently manufactured and marketed.

It is a further object of the present invention to provide a new liquid barrier system which is of a durable and reliable construction.

An even further object of the present invention is to provide a new liquid barrier system which is susceptible of a low cost of manufacture with regard to both materials and labor, and which accordingly is then susceptible of low prices of sale to the consuming public, thereby making such liquid barrier system economically available to the buying public.

Still yet another object of the present invention is to provide a new liquid barrier system which provides in the apparatuses and methods of the prior art some of the advantages thereof, while simultaneously overcoming some of the disadvantages normally associated therewith.

Still another object of the present invention is to provide a new liquid barrier system for protecting selected areas of flooring from liquid flow.

Yet another object of the present invention is to provide a new liquid barrier system which includes a pair of end assemblies adapted for abutting a surface of a floor, and an elongate barrier assembly having two ends, each one of the barrier assembly ends being coupled to an associated one of the end assemblies.

Still yet another object of the present invention is to provide a new liquid barrier system that is simple to setup and move.

Even still another object of the present invention is to provide a new liquid barrier system that conforms to a variety of shapes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
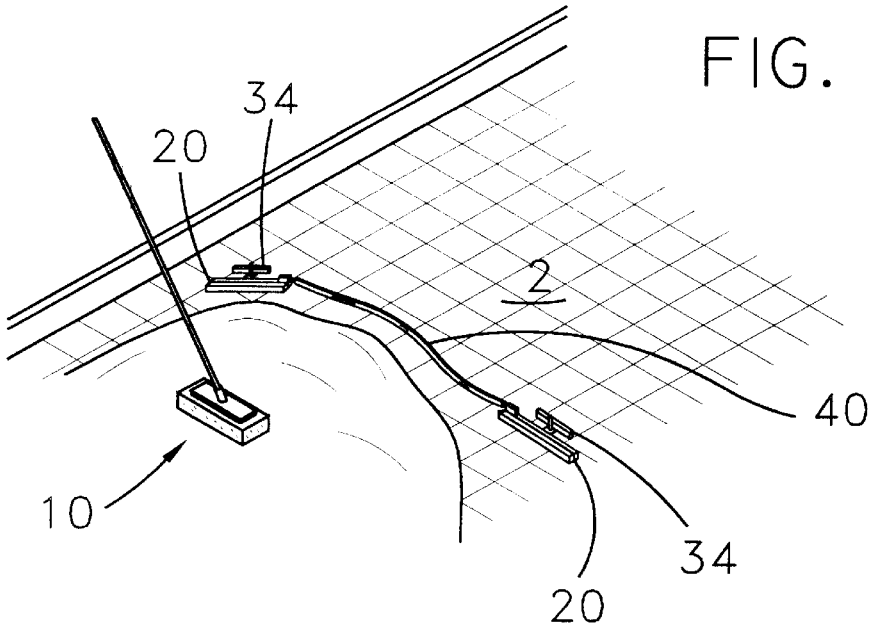
FIG. 1 is a schematic perspective view of a new liquid barrier system in use according to the present invention.
Figure 2:
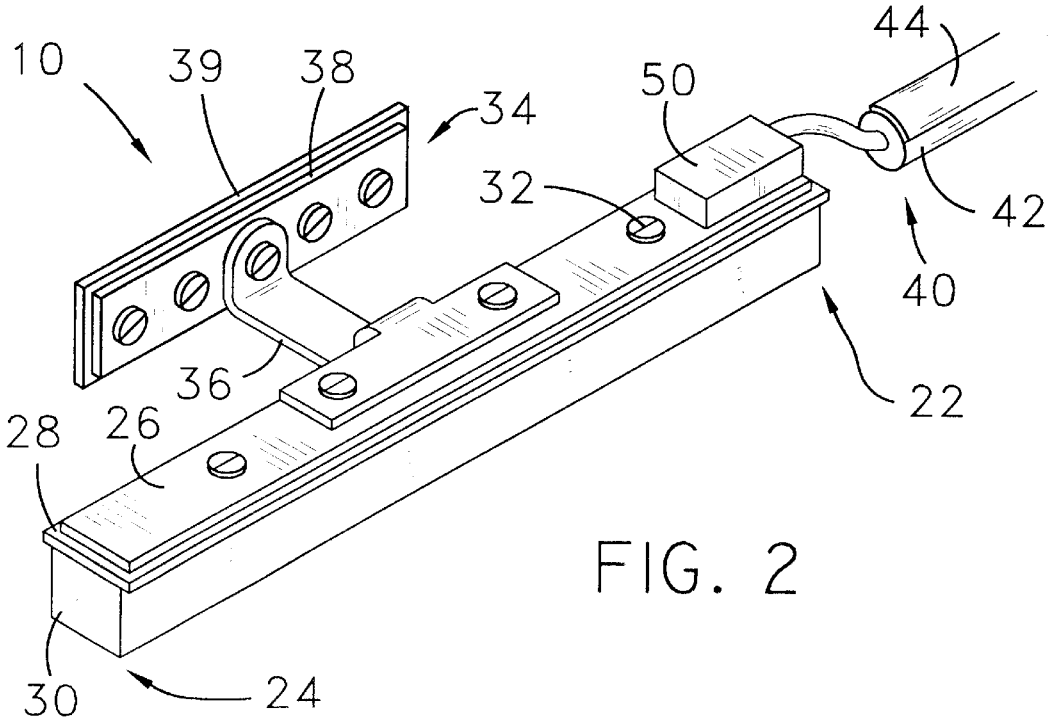
FIG. 2 is a schematic perspective view of the present invention.
Figure 4:
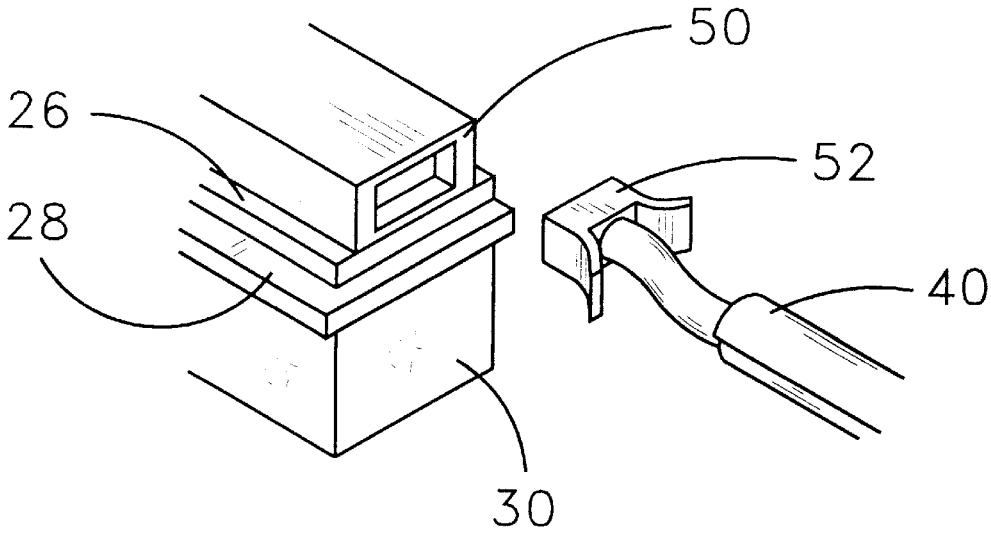
FIG. 4 is a schematic perspective view of the connecting receptacle and connecting plug of the present invention.
Figure 3:
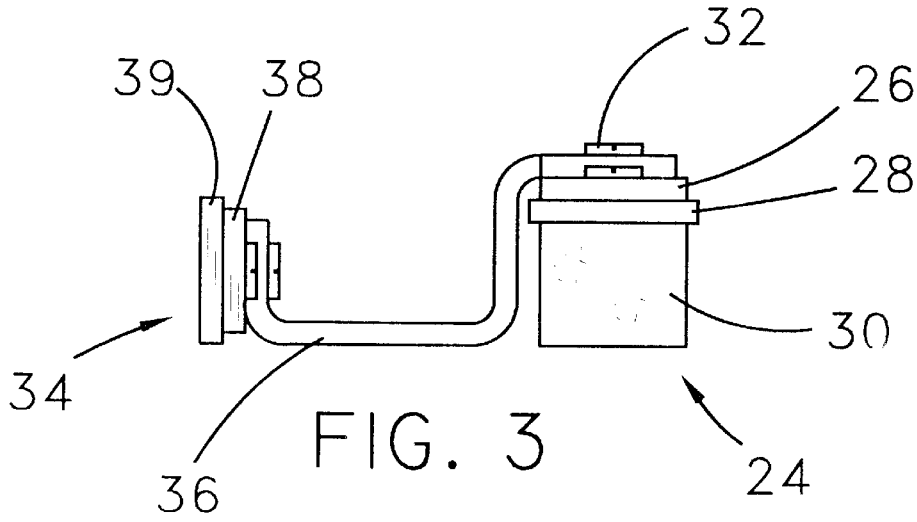
FIG. 3 is a schematic side view of an end assembly of the present invention.

With reference now to the drawings, and in particular to FIGS. 1 through 4 thereof, a new liquid barrier system embodying the principles and concepts of the present invention and generally designated by the reference numeral 10 will be described.

As best illustrated in FIGS. 1 through 4, the liquid barrier system 10 generally comprises a pair of end assemblies 20 and a barrier assembly 40.

Each of the end assemblies 20 is designed for abutting a surface of a floor 2.

The barrier assembly 40 is elongate. The barrier assembly 40 is coupled to an end portion 22 of each of the end assemblies 20 such that the end assemblies 20 and the barrier assembly 40 form a barrier which extends from a first one of the end assemblies 20 to a second one of the end assemblies 20.

The barrier assembly 40 is flexible such that a longitudinal axis of the barrier assembly 40 is conformable to a desired shape.

The barrier assembly 40 includes a cover portion 42. The cover portion 42 is substantially non-absorbent such that a liquid on a first side of the barrier formed by the end assemblies 20 and the barrier assembly 40 is discouraged from flowing through the barrier assembly 40 when the barrier assembly 40 abuts the floor 2.

The barrier assembly 40 is weighted such that a liquid on the first side of the barrier formed by the end assemblies 20 and the barrier assembly 40 is discouraged from flowing under the barrier assembly 40 when the barrier assembly 40 abuts the floor 2.

The barrier assembly 40 includes an arcuate weighting member 44. The weighting member 44 is coupled to an upper surface of the barrier assembly 40. The weighting member 44 conforming to the upper surface.

Each of the end assemblies 20 includes a blocking portion 24. The blocking portion 24 includes a connecting strip 26, an elastomeric member 28, and a squeegy member 30. The barrier assembly 40 is coupled to the connecting strip 26. The elastomeric member 28 is positioned substantially between a bottom surface of the connecting strip 26 and a top surface of the squeegy member 30.

The squeegy member 30 comprises a non-absorbent material. The squeegy member 30 is designed for abutting the floor 2 and moving a liquid across a surface of the floor 2 when the squeegy member 30 is drawn across the surface of the floor 2.

Each of the end assemblies 20 includes a plurality of connecting members 32. Each of the connecting strips 26 includes a plurality of apertures. Each of the elastomeric members 28 includes a plurality of apertures, which are alignable with the apertures of the connecting strip 26. Each of the squeegy members 30 includes a plurality of apertures. The apertures of the squeegy member 30 are alignable with the apertures of the elastomeric member 28 and the apertures of the connecting strip 26. The connecting members 32 extend through the apertures of the connecting strip 26, the elastomeric member 28, and the squeegy member 30.

Each of the end assemblies 20 includes a support portion 34. The support portion 34 includes a support bracket 36 for coupling the support portion 34 to the blocking portion 24. The support bracket 36 has two substantially L-shaped portions. The support portion 34 is designed for abutting the surface of the floor 2 for stabilizing the end assembly 20.

The support portion 34 includes a weight member 38 and an elastomeric member 39. The elastomeric member 39 is designed for abutting the surface of the floor 2 preventing the support portion 34 from sliding across the surface. The weight member 38 is for preventing the support portion from sliding.

Each of the end assemblies 20 includes a connecting receptacle 50. The barrier assembly 40 includes opposite ends. Each of the opposite ends includes a connecting plug 52. Each of the connecting plugs 52 is selectively couplable with the connecting receptacles 50 such that each of the opposite ends of the barrier assembly 40 is selectively couplable with an associated one of the end assemblies 20.

In use, an area of flooring is selected, by the user, for cleaning and or waxing. The area adjacent to the selected area defines a perimeter. A first one of the end assemblies is placed at one end of the perimeter. The second one of the end assemblies is placed at the opposite end of the perimeter. The barrier assembly is then placed along the perimeter between the two end assemblies.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A liquid barrier system comprising:

a pair of end assemblies, each of said end assemblies being adapted for abutting a surface of a floor;

a barrier assembly, said barrier assembly being elongate, said barrier assembly being coupled to an end portion of each of said end assemblies such that said end assemblies and said barrier assembly forming a barrier extending from a first one of said end assemblies to a second one of said end assemblies; and each of said end assemblies having a blocking portion, said blocking portion having a connecting strip, an elastomeric member, and a squeegy member, said barrier assembly being coupled to said connecting strip, said elastomeric member being positioned substantially between a bottom surface of said connecting strip and a top surface of said squeegy member.

2. The liquid barrier system of claim 1, further comprising:

said barrier assembly being flexible such that a longitudinal axis of said barrier assembly is conformable to a desired shape.

3. The liquid barrier system of claim 1, further comprising:

said barrier assembly having a cover portion, said cover portion being substantially non-absorbent such that a liquid on a first side of said barrier formed by said end assemblies and said barrier assembly is discouraged from flowing through said barrier assembly when said barrier assembly abuts the floor.

4. The liquid barrier system of claim 1, further comprising:

said barrier assembly being weighted such that a liquid on said first side of said barrier formed by said end assemblies and said barrier assembly is discouraged from flowing under said barrier assembly when said barrier assembly abuts the floor.

5. The liquid barrier system of claim 4, further comprising:

said barrier assembly including an arcuate weighting member, said weighting member being.coupled to an upper surface of said barrier assembly, said weighting member conforming to said upper surface.

6. The liquid barrier system of claim 1, further comprising:

said squeegy member comprising a non-absorbent material, said squeegy member being adapted for abutting the floor and moving a liquid across a surface of the floor when the squeegy member is drawn across the surface of the floor.

7. The liquid barrier system of claim 1, further comprising:

a plurality of connecting members;

each of said connecting strips having a plurality of apertures;

each of said elastomeric members having a plurality of apertures alignable with said apertures of said connecting strip;

each of said squeegy members having a plurality of apertures, said apertures of said squeegy member being alignable with said apertures of said elastomeric member and said apertures of said connecting strip;

said connecting members extending through said apertures of said connecting strip, said elastomeric member, and said squeegy member.

8. The liquid barrier system of claim 1, further comprising:

each of said end assemblies having a support portion, said support portion having a support bracket for coupling said support portion to said blocking portion, said support portion being adapted for abutting the surface of the floor for stabilizing said end assembly.

9. The liquid barrier system of claim 8, further comprising:

said support portion having a weight member and an elastomeric member, said elastomeric member being adapted for abutting the surface of the floor preventing said support portion from sliding across the surface, said weight member being for preventing said support portion from sliding.

10. The liquid barrier system of claim 1, further comprising:

each of said end assemblies having a connecting receptacle;

said barrier assembly having opposite ends, each of said opposite ends having a connecting plug;

each of said connecting plugs being selectively couplable with said connecting receptacles such that each of said opposite ends of said barrier assembly being selectively couplable with an associated one of said end assemblies.

11. The liquid barrier system of claim 8, further comprising:

said support bracket having a first L-shaped portion and a second L-shaped portion, a first side of said first L-shaped portion being adapted for abutting the floor, a second side of said first L-shaped bracket being for coupling to said support portion, a first side of said second portion extending adjacent a back surface of said end assembly, a second side of said second portion being for coupling to said end assembly, an end of said first side of said second portion of said support bracket being integrally coupled to an end of said first side of said first portion of said support bracket, said first side of said first portion of said support bracket providing a support base positioned perpendicular to a longitudinal axis of said support member.

12. A liquid barrier system comprising:

a pair of end assemblies, each of said end assemblies being adapted for abutting a surface of a floor;

a barrier assembly, said barrier assembly being elongate, said barrier assembly being coupled to an end portion of each of said end assemblies such that said end assemblies and said barrier assembly forming a barrier extending from a first one of said end assemblies to a second one of said end assemblies;

said barrier assembly being flexible such that a longitudinal axis of said barrier assembly is conformable to a desired shape;

said barrier assembly having a cover portion, said cover portion being substantially non-absorbent such that a liquid on a first side of said barrier formed by said end assemblies and said barrier assemblies is discouraged from flowing through said barrier assemblies when said barrier assemblies abuts the floor;

said barrier assembly being weighted such that a liquid on said first side of said barrier formed by said end assemblies and said barrier assembly is discouraged from flowing under said barrier assembly when said barrier assembly abuts the floor;

said barrier assembly including an arcuate weighting member, said weighting member being coupled to an upper surface of said barrier assembly, said weighting member conforming to said upper surface;

each of said end assembly having a blocking portion, said blocking portion having a connecting strip, and elastomeric member, and a squeegy member, said barrier assemblies being coupled to said connecting strip, said elastomeric member being positioned substantially between a bottom surface of said connecting strip and a top surface of said squeegy member;

said squeegy member comprising a non-absorbent material, said squeegy member being adapted for abutting the floor and moving a liquid across a surface of the floor when the squeegy member is drawn across the surface of the floor.;

a plurality of connecting members;

each of said connecting strips having a plurality of apertures;

each of said elastomeric members having a plurality of apertures alignable with said apertures of said connecting strip;

each of said squeegy members having a plurality of apertures, said apertures of said squeegy member being alignable with said apertures of said elastomeric member and said apertures of said connecting strip;

said connecting members extending through said apertures of said connecting strip, said elastomeric member, and said squeegy member;

each of said end assemblies having a support portion, said support portion having a support bracket for coupling said support portion to said blocking portion, said support portion being,adapted for abutting the surface of the floor for stabilizing said end assembly;

said support portion having a weight member and an elastomeric member, said elastomeric member being adapted for abutting the surface of the floor preventing said support portion from sliding across the surface, said weight member being for preventing said support portion from sliding;

each of said end assemblies having a connecting receptacle;

said barrier assembly having opposite ends, each of said opposite ends having a connecting plug; and each of said connecting plugs being selectively couplable with said connecting receptacles such that each of said opposite ends of said barrier assembly being selectively couplable with an associated one of said end assemblies.

* * * * *